US011501687B1

(12) United States Patent
Yeh et al.

(10) Patent No.: US 11,501,687 B1
(45) Date of Patent: Nov. 15, 2022

(54) IMAGE PROCESSING CIRCUIT AND IMAGE PROCESSING METHOD THEREOF

(71) Applicant: Novatek Microelectronics Corp., Hsinchu (TW)

(72) Inventors: Chao-Chi Yeh, Miaoli County (TW); Shih-Hsuan Chen, Taoyuan (TW); Chun-Ping Niou, Changhua County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/496,737

(22) Filed: Oct. 7, 2021

(51) Int. Cl.
*G09G 3/20* (2006.01)
*G09G 3/36* (2006.01)
*G09G 3/00* (2006.01)

(52) U.S. Cl.
CPC ..... *G09G 3/2044* (2013.01); *G09G 3/006* (2013.01); *G09G 3/2051* (2013.01); *G09G 3/3648* (2013.01); *G09G 3/3688* (2013.01); *G09G 2310/027* (2013.01)

(58) Field of Classification Search
CPC .. G09G 3/2044; G09G 3/2051; G09G 3/3611; G09G 3/3648; G09G 3/3688; G09G 3/006; G09G 2310/027
See application file for complete search history.

(56) References Cited

U.S. PATENT DOCUMENTS 8,300,890 B1 * 10/2012 Gaikwad ..... H04N 5/144 382/173
8,648,959 B2 * 2/2014 Capata ..... G06V 40/166 348/169
9,349,161 B2 * 5/2016 Tamura ..... G06T 5/003
2002/0089514 A1 * 7/2002 Kitahara ..... H04N 1/6058 345/600
2008/0001975 A1 * 1/2008 Obara ..... G06T 5/20 348/E5.073
2015/0269904 A1 * 9/2015 Tsai ..... G09G 5/02 345/520

* cited by examiner

*Primary Examiner* — Vijay Shankar
(74) *Attorney, Agent, or Firm* — JCIPRNET

(57) ABSTRACT

An image processing circuit is provided. The image processing circuit includes a dither computing circuit and a blending circuit. The dither computing circuit performs a dither computing on the input grayscale data to generate a dithered grayscale data. The blending circuit receives the input grayscale data and the dithered grayscale data, generates a blending weight by comparing the input grayscale data with a first threshold, and performs a blending computing on the input grayscale data and the dithered grayscale data based on the blending weight to output an output grayscale data.

15 Claims, 4 Drawing Sheets

IMAGE PROCESSING CIRCUIT AND IMAGE PROCESSING METHOD THEREOF

BACKGROUND

Technical Field

The invention generally relates to an image processing circuit and an image processing method. More particularly, the invention relates to the image processing circuit and the image processing method for processing.

Description of Related Art

Traditionally, in order to increase the continuity of the gradient zone of the LED display, the color depth would be increased to eliminate the contour phenomenon. Since increasing the color depth requires higher costs, a dither computing is usually adopted. The dither computing adds various dithering values to grayscale data to make grayscale data changes smoothly, thereby visually equivalently increasing the color depth to compensate for the contour phenomenon.

However, the dither computing results in a flicker phenomenon. The dither computing includes truncating lower bit(s) of original grayscale data that is with the expected bit depth and adding dithering value(s) to the truncated grayscale data, so as to generate a plurality of dithered grayscale data to be displayed according to a given time sequence. Please referring to FIG. 6, which is an exemplary diagram illustrating the flicker phenomenon caused by the dither computing. For example, an expected 15-bits data may be processed by the dither computing to generate a plurality of 13-bits data to be displayed. However, for a pixel location, if expected pixel data remains the same low grayscale such as grayscale data '1' for a long time, as shown in FIG. 6, after dither computing the pixel may display zero grayscale (i.e. dark pixel) most of time and display non-zero grayscale data periodically, thereby the flicker phenomenon is easily perceived by eyes. When the expected pixel data of the entire frame of the LED display are same low grayscale and refresh rate is lower than 60 frames/second, the flicker phenomenon become severe.

SUMMARY

The invention is directed to an image processing circuit and an image processing method, by which the flicker phenomenon can be reduced while dithering is applied.

An embodiment of the invention provides an image processing circuit. The image processing circuit includes a dither computing circuit and a blending circuit. The dither computing circuit is configured to receive an input grayscale data, and perform a dither computing on the input grayscale data to generate a dithered grayscale data. The blending circuit is coupled to the dither computing circuit. The blending circuit is configured to receive the input grayscale data and the dithered grayscale data, generate a blending weight by comparing the input grayscale data with a first threshold, and perform a blending computing on the input grayscale data and the dithered grayscale data based on the blending weight to output an output grayscale data.

In an embodiment of the invention, the dither computing circuit truncates the input grayscale data to generate a truncated input graysc ale data and adds a dithering value to the truncated input grayscale data according to a lookup table, to generate the dithered grayscale data.

In an embodiment of the invention, the blending circuit calculates a difference between the input grayscale data and the first threshold, multiplies the difference by a gain value, and truncates a result of the difference multiplied by the gain value to generate the blending weight.

In an embodiment of the invention, the blending circuit outputs the input grayscale data as the output grayscale data in response to that the blending weight equals zero.

In an embodiment of the invention, the blending circuit generates zero as the blending weight in response to the difference indicating that the input grayscale data is not greater than the first threshold.

In an embodiment of the invention, the blending circuit outputs the dithered grayscale data as the output grayscale data in response to that the blending weight equals a predetermined value which is the maximum value of the blending weight.

In an embodiment of the invention, the blending circuit generates the predetermined value as the blending weight in response to the difference indicating that the input grayscale data is greater than a second threshold, and wherein the predetermined value is the maximum value of the blending weight and the second threshold is determined based on the first threshold, the maximum value of the blending weight and the gain value.

In an embodiment of the invention, the blending circuit performs the blending computing based on a following equation.

$$\mathrm{OUT} = \frac{(BWMAX - BW) * \mathrm{IN} + BW * IND}{BWMAX}$$

OUT represents the output grayscale data, IN represents the input grayscale data, IND represents the dithered grayscale data, BWMAX represents a maximum of the blending weight, and BW represents the blending weight.

In an embodiment of the invention, the image processing circuit is disposed in a driving controller of a light emitting diode display.

An embodiment of the invention provides an image processing method. The image processing method includes: performing a dither computing on the input grayscale data to generate a dithered grayscale data; generating a blending weight by comparing the input grayscale data with a first threshold value; and performing a blending computing on the input grayscale data and the dithered grayscale data based on the blending weight to output an output grayscale data.

In an embodiment of the invention, the step of performing the dither computing on the input grayscale data to generate the dithered grayscale data includes: truncating the input grayscale data to generate a truncated input grayscale data and adding a dithering value to the truncated input grayscale data according to a lookup table to generate the dithered grayscale data.

In an embodiment of the invention, the step of generating the blending weight by comparing the input grayscale data with the first threshold includes: calculating a difference between the input grayscale data and the first threshold, multiplying the difference by a gain value, and truncating a result of the difference multiplied by the gain value to generate the blending weight.

In an embodiment of the invention, the image processing method further includes outputting the input grayscale data as the output grayscale data in response to that the blending weight equals zero.

In an embodiment of the invention, the image processing method further includes generating zero as the blending weight in response to the difference indicating that the input data is not greater than the first threshold.

In an embodiment of the invention, the step of generating the blending weight by comparing the input grayscale data with the first threshold further includes: outputting the dithered grayscale data as the output grayscale data in response to that the blending weight equals a predetermined value which is the maximum value of the blending weight.

In an embodiment of the invention, the step of generating the blending weight by comparing the input grayscale data with the first threshold further includes: generating the predetermined value as the blending weight in response to the difference indicating that the input grayscale data is greater than a second threshold, and wherein the predetermined value is the maximum value of the blending weight and the second threshold is determined based on the first threshold, the maximum value of the blending weight and the gain value.

In an embodiment of the invention, the step of performing the blending computing is based on a following equation.

$$\mathrm{OUT} = \frac{(BWMAX - BW) * \mathrm{IN} + BW * IND}{BWMAX}$$

OUT represents the output grayscale data, IN represents the input grayscale data, IND represents the dithered grayscale data, BWMAX represents a maximum of the blending weight, and BW represents the blending weight.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Embodiments are provided below to describe the disclosure in detail, though the disclosure is not limited to the provided embodiments, and the provided embodiments can be suitably combined. The term "coupling/coupled" or "connecting/connected" used in this specification (including claims) of the application may refer to any direct or indirect connection means. For example, "a first device is coupled to a second device" should be interpreted as "the first device is directly connected to the second device" or "the first device is indirectly connected to the second device through other devices or connection means." The term "signal" can refer to a current, a voltage, a charge, a temperature, data, electromagnetic wave or any one or multiple signals. In addition, the term "and/or" can refer to "at least one of". For example, "a first signal and/or a second signal" should be interpreted as "at least one of the first signal and the second signal".

Figure 1:
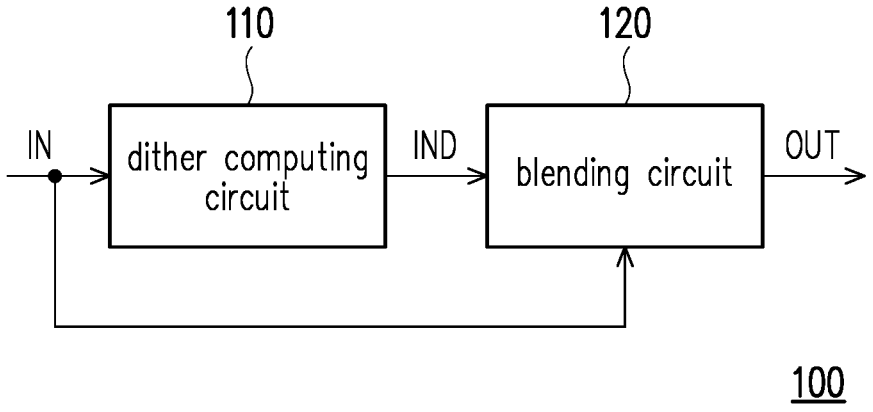
FIG. 1 is a block diagram illustrating an image processing circuit according to an embodiment of the invention.

FIG. 1 is a block diagram illustrating an image processing circuit 100 according to an embodiment of the invention. The image processing circuit 100 of the present embodiment at least includes a dither computing circuit 110 and a blending circuit 120. In an embodiment, the image processing circuit 100 is disposed in a driving controller of a light emitting diode (LED) display (not shown). The blending circuit 120 is configurable to be coupled to the dither computing circuit 110.

In the present embodiment, the image processing circuit 100 may be an electronic device having an image processing function. In an embodiment, the image processing circuit 100 may be, but not limited to, a central processing unit (CPU) or a programmable microprocessor, a digital signal processor (DSP), a programmable controller, an application specific integrated circuit (ASIC) or other similar devices or a combination of above-mentioned devices disposed in a driving controller of a light emitting diode (LED) display. The image processing circuit 100 receives input grayscale data IN of an image and performs the image processing function on the input grayscale data IN to generate output grayscale data OUT for improving the continuity of the gradient zone of the image through a digital signal processing. Each of the input grayscale data IN and the output grayscale data OUT may include a set of bits indicating a grayscale value, such as the grayscale 1 and the grayscale 4 shown in FIG. 3B.

Figure 2:
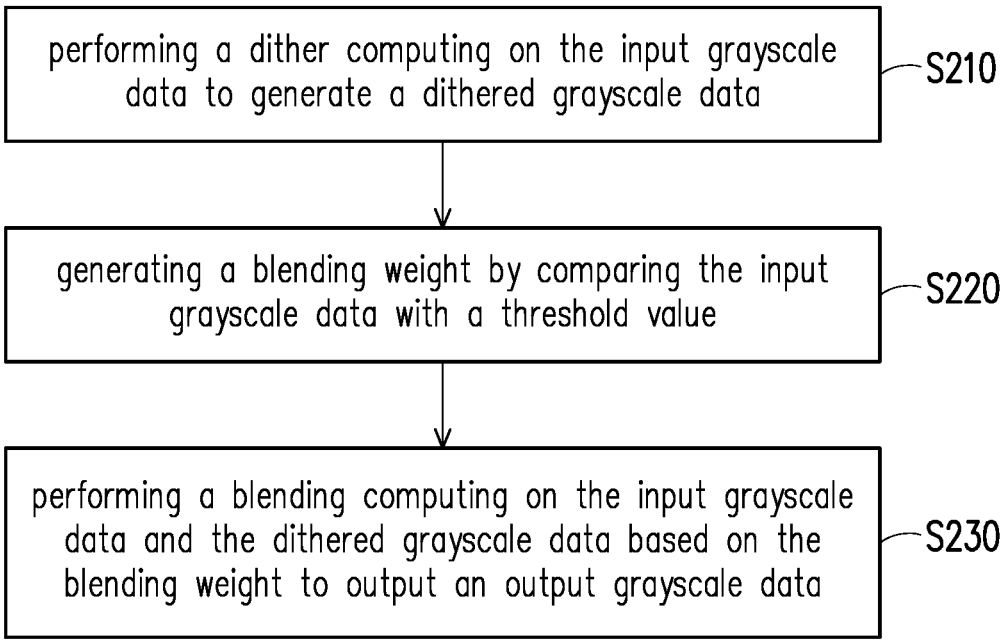
FIG. 2 is a flowchart illustrating an image processing method according to an embodiment of the invention.

FIG. 2 is a flowchart illustrating an image processing method according to an embodiment of the invention. Referring to FIG. 1 and FIG. 2, in step S210, the dither computing circuit 110 is configured to receive an input grayscale data IN, and perform the dither computing on the input grayscale data IN to generate a dithered grayscale data IND. Specifically, truncating the input grayscale data IN and adding a dithering value to the truncated input grayscale data INT (not shown) are performed during the dither computing, and the detail will be discussed in FIG. 3A and FIG. 3B.

Next, in step S220, the blending circuit 120 receives the input grayscale data IN and dithered grayscale data IND, and the blending circuit 120 compares the dithered grayscale data IND with a first threshold TH1 to generate a blending weight BW. The first threshold TH1 is a reference grayscale for comparing and may be preset according to a design requirement, and the blending weight BW is computed to determine the weights of the input grayscale data IN and the dithered grayscale data IND. Specifically, the blending circuit 120 generates a blending weight BW by means of the dithered grayscale data IND, the first threshold TH1, and a gain value M1. The detail will be discussed in FIG. 4 and FIG. 5.

In step S230, the blending circuit 120 performs a blending computing on the input grayscale data IN and the dithered grayscale data IND based on the blending weight BW to generate an output grayscale data OUT. In particular, the blending circuit 120 computes the output grayscale data OUT by blending the input grayscale data IN and the dithered grayscale data IND through the blending weight BW. The detail will be discussed thereafter.

Figure 3A:
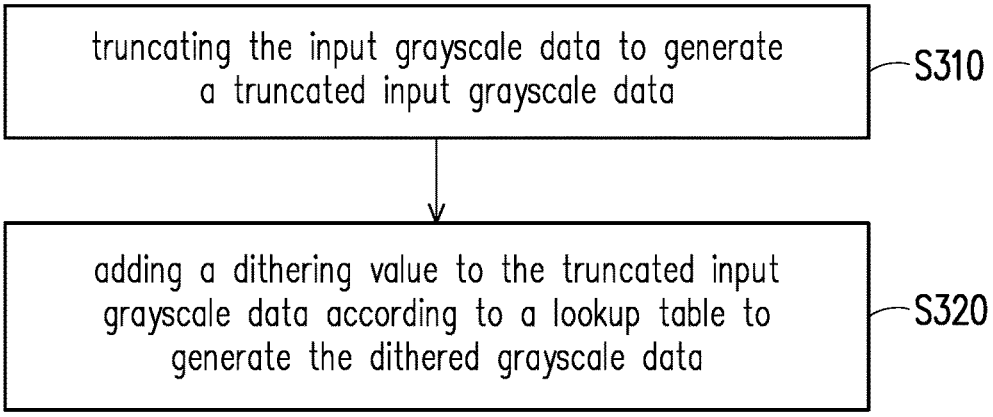
FIG. 3A is a flowchart illustrating the step S210 of FIG. 2 according to an embodiment of the invention.
Figure 3B:
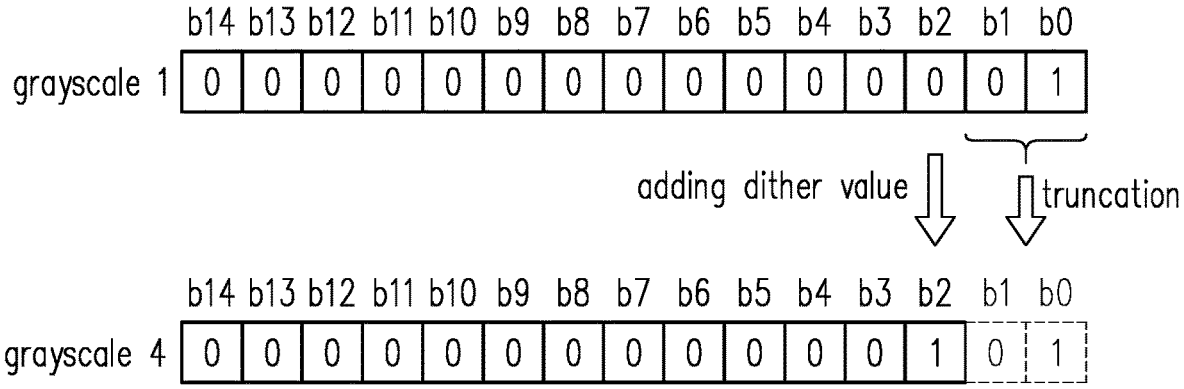
FIG. 3B is an exemplary diagram illustrating the dither computing.

FIG. 3A is a flowchart illustrating the step S210 of FIG. 2 according to an embodiment of the invention. Referring to FIG. 3A, in step S310, the dither computing circuit 110 truncates the input grayscale data IN to generate a truncated input grayscale data INT. Specifically, the dither computing circuit 110 truncates a part of bits of the input grayscale data IN, to generate a truncated input grayscale data INT with a less bit number. FIG. 3B is an exemplary diagram illustrating the dither computing. For example, in FIG. 3B, b0 and b1 are truncated so that the color depth is reduced from 15 bits (input grayscale data IN) to 13 bits (truncated input grayscale data INT).

Next, in step S320, the dither computing circuit 110 adds a dithering value to the truncated input grayscale data INT according to a lookup table (LUT), to generate the dithered grayscale data IND. There may be a plurality of dithering values in the lookup table, and the dithering values may be selected sequentially or randomly to be added into the each truncated input grayscale data INT, but not limited. For example, in FIG. 3B, the dithering value 1 is added into b2, so that the 15-bits grayscale 1 is modified to be the 13-bits grayscale 4. As such, the dithered grayscale data IND is generated through the dither computing.

Figure 4:
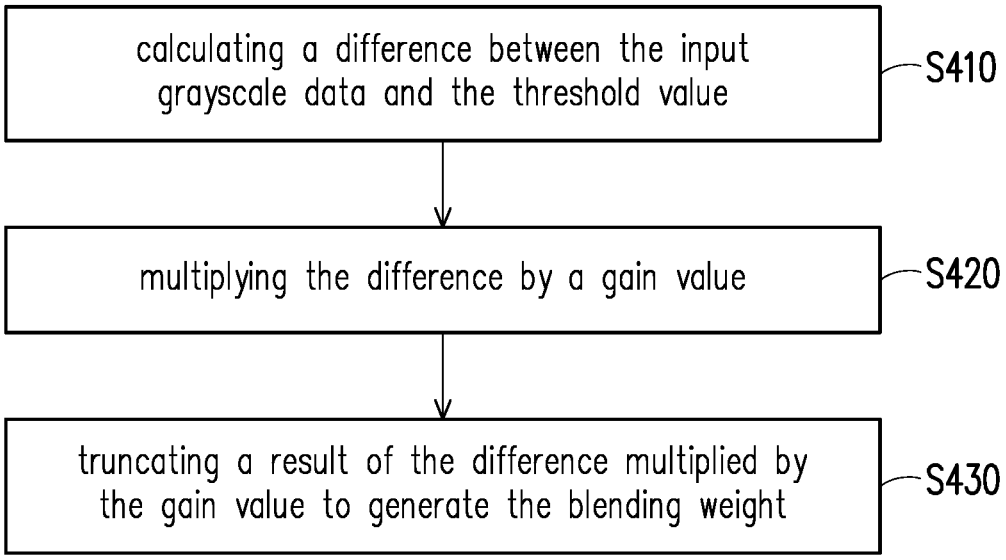
FIG. 4 is a flowchart illustrating the step S220 of FIG. 2 according to an embodiment of the invention.
Figure 5:
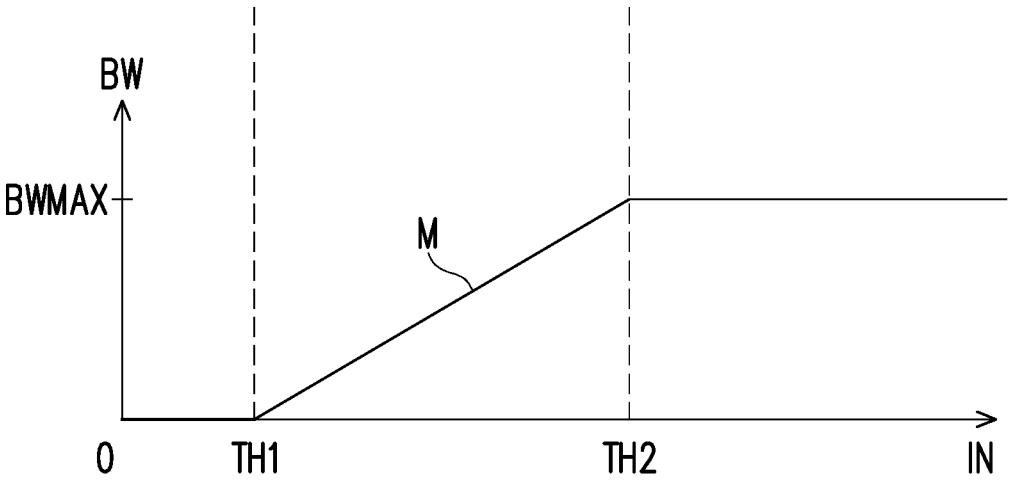
FIG. 5 is an exemplary diagram illustrating the blending weight versus the input grayscale data according to an embodiment of the invention.
Figure 6:
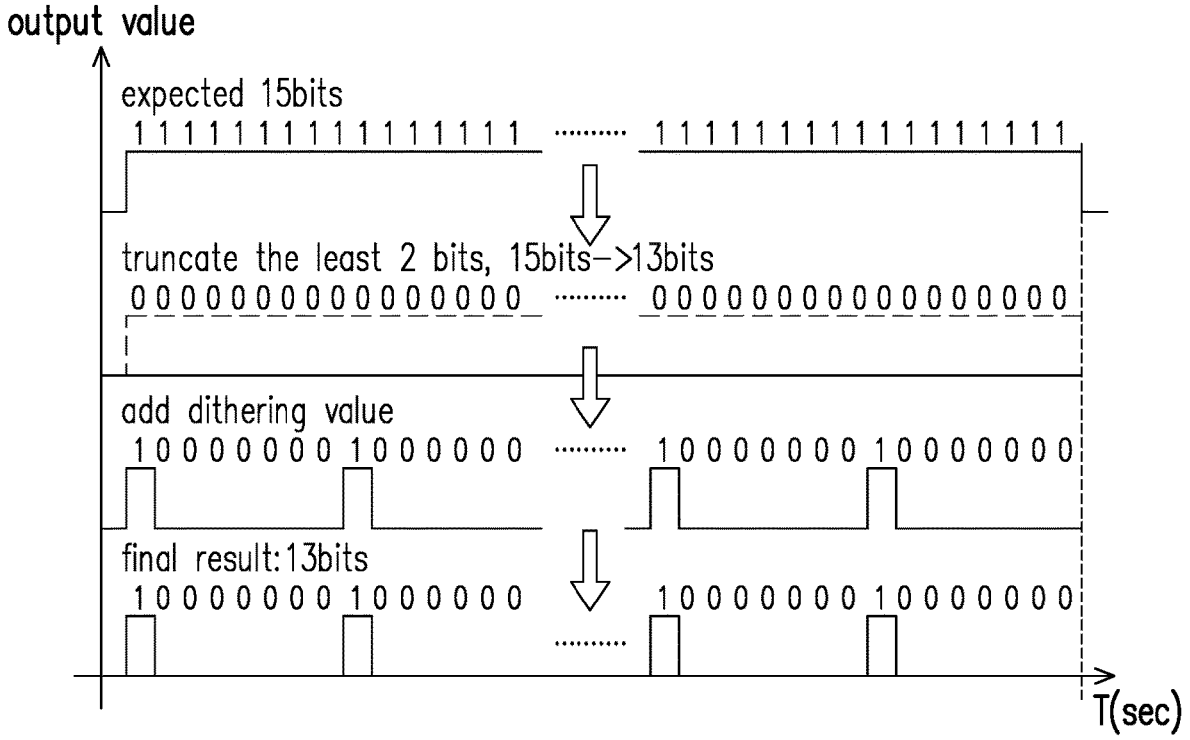
FIG. 6 is an exemplary diagram illustrating the flicker phenomenon caused by the dither computing.

FIG. 4 is a flowchart illustrating the step S220 of FIG. 2 according to an embodiment of the invention. Referring to FIG. 4, in step S410, the blending circuit 120 calculates a difference (IN−TH1) between the input grayscale data IN and the first threshold TH1. Next, in step S420, the blending circuit 120 multiplies the difference (IN−TH1) by a gain value M1 to generate a result of (IN−TH1)*M1. The gain value M1 is a reference value and may be preset according to a design requirement. In step S430, the blending circuit 120 truncates the result (IN−TH1)*M1 by X bits to generate the blending weight BW as shown in FIG. 5 and the blending weight BW can be calculated as shown in equation (1). It is noted that the gain value M1>>X is equivalent to a slope M of the blending weight BW versus the input grayscale data IN shown in FIG. 5. Briefly, the blending weight BW can be calculated as shown in equation (1).

$$BW=(IN-TH1)*M1>>X \tag{1}$$

FIG. 5 is an exemplary diagram illustrating the blending weight BW versus the input grayscale data IN according to an embodiment of the invention. Please referring to FIG. 5, equation (1) and equation (2), the blending circuit 120 performs a blending computing to generate an output grayscale data OUT according to equation (2):

$$\text{OUT} = \frac{(BWMAX - BW)*\text{IN} + (BW)*IND}{BWMAX} \tag{2}$$

When the difference (IN−TH1) indicates that the input grayscale data IN is not greater than the first threshold TH1, the blending circuit 120 generates zero as the blending weight BW. When the blending weight BW equals zero, the blending circuit 120 stops the dither computing and directly outputs the input grayscale data IN as the output grayscale data OUT, so as to save computer resource. In other words, when the input grayscale data IN is small enough, the output grayscale data OUT includes less part from the dithered grayscale data IND but includes more part from the input grayscale data IN. When the difference (IN−TH1) indicates that the input grayscale data IN is greater than the first threshold TH1 and not greater the second threshold TH2, the blending weight BW will be gradually increased to a maximum value of the blending weigh BWMAX with the input grayscale data IN, and the slope M of the blending weight BW versus the input grayscale data IN can be obtained through the grain value M1>>X. In other words, when the input grayscale data IN is greater, there is more part from the dithered grayscale data IND (while less part from the input grayscale data IN) included in the output grayscale data OUT.

When the difference (IN−TH1) indicates that the input grayscale data IN is greater than a second threshold TH2 (by comparing (IN−TH1) with (TH2−TH1)), the blending circuit 120 generates the predetermined value as the blending weight BW. It is noted that the maximum value of the blending weight BWMAX and the gain value M are preset according design requirements, and the second threshold TH2 could be computed by means of the first threshold TH1, the maximum value of the blending weight BWMAX and the gain value M.

When the blending weight BW equals a predetermined value which is the maximum value of the blending weigh BWMAX, the blending circuit 120 outputs the dithered grayscale data IND as the output grayscale data OUT, so as to save computer resource.

Based on above, the blending computing of the invention decreases the dither ratio under the low input grayscale, leading to reduce the flicker phenomenon shown in LED display. Therefore, the side effect of the dither computing would be solved with a smooth gradient zone, so as to improve the user experience.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An image processing circuit, comprising:

a dither computing circuit, configured to receive an input grayscale data, and perform a dither computing on the input grayscale data to generate a dithered grayscale data; and a blending circuit, coupled to the dither computing circuit, configured to receive the input grayscale data and the dithered grayscale data, generate a blending weight by comparing the input grayscale data with a first threshold, and perform a blending computing on the input grayscale data and the dithered grayscale data based on the blending weight to output an output grayscale data, wherein in response to that the input grayscale data is not greater than the first threshold, the blending circuit outputs the output grayscale data which equals the input grayscale data.

2. The image processing circuit as claimed in claim 1, wherein the step of performing the dither computing on the input grayscale data to generate the dithered grayscale data comprises:

the dither computing circuit truncates the input grayscale data to generate a truncated input grayscale data and adds a dithering value to the truncated input grayscale data according to a lookup table to generate the dithered grayscale data.

3. The image processing circuit as claimed in claim 1, wherein the step of generating the blending weight by comparing the input grayscale data with the first threshold comprises:

the blending circuit calculates a difference between the input grayscale data and the first threshold, multiplies the difference by a gain value, and truncates a result of the difference multiplied by the gain value to generate the blending weight.

4. The image processing circuit as claimed in claim 1, wherein the blending circuit generates zero as the blending weight in response to the difference indicating that the input grayscale data is not greater than the first threshold.

5. The image processing circuit as claimed in claim 3, wherein the blending circuit outputs the dithered grayscale data as the output grayscale data in response to that the blending weight equals a predetermined value which is the maximum value of the blending weight.

6. The image processing circuit as claimed in claim 5, wherein the blending circuit generates the predetermined value as the blending weight in response to the difference indicating that the input grayscale data is greater than a second threshold, and wherein the predetermined value is the maximum value of the blending weight and the second threshold is determined based on the first threshold, the maximum value of the blending weight and the gain value.

7. The image processing circuit as claimed in claim 1, wherein the blending circuit performs the blending computing based on a following equation:

$$\mathrm{OUT} = \frac{(BWMAX - BW) * \mathrm{IN} + BW * IND}{BWMAX}$$

wherein OUT represents the output grayscale data, IN represents the input grayscale data, IND represents the dithered grayscale data, BWMAX represents a maximum of the blending weight, and BW represents the blending weight.

8. The image processing circuit as claimed in claim 1, wherein the image processing circuit is disposed in a driving controller of a light emitting diode display.

9. An image processing method, comprising:

performing a dither computing on the input grayscale data to generate a dithered grayscale data;

generating a blending weight by comparing the input grayscale data with a first threshold; and performing a blending computing on the input grayscale data and the dithered grayscale data based on the blending weight to output an output grayscale data;

wherein in response to that the input grayscale data is not greater than the first threshold, outputting the output grayscale data which equals the input grayscale data.

10. The image processing method as claimed in claim 9, wherein the step of performing the dither computing on the input grayscale data to generate the dithered grayscale data comprises:

truncating the input grayscale data to generate a truncated input grayscale data and adding a dithering value to the truncated input grayscale data according to a lookup table to generate the dithered grayscale data.

11. The image processing method as claimed in claim 9, wherein the step of generating the blending weight by comparing the input grayscale data with the first threshold comprises:

calculating a difference between the input grayscale data and the first threshold, multiplying the difference by a gain value, and truncating a result of the difference multiplied by the gain value to generate the blending weight.

12. The image processing method as claimed in claim 9, wherein generating zero as the blending weight in response to the difference indicating that the input grayscale data is not greater than the first threshold.

13. The image processing method as claimed in claim 11, wherein outputting the dithered grayscale data as the output grayscale data in response to that the blending weight equals a predetermined value which is the maximum value of the blending weight.

14. The image processing method as claimed in claim 13, wherein generating the predetermined value as the blending weight in response to the difference indicating that the input grayscale data is greater than a second threshold, and wherein the predetermined value is the maximum value of the blending weight and the second threshold is determined based on the first threshold, the maximum value of the blending weight and the gain value.

15. The image processing method as claimed in claim 9, wherein the step of performing the blending computing is based on a following equation:

$$\mathrm{OUT} = \frac{(BWMAX - BW) * \mathrm{IN} + BW * IND}{BWMAX}$$

wherein OUT represents the output grayscale data, IN represents the input grayscale data, IND represents the dithered grayscale data, BWMAX represents a maximum of the blending weight, and BW represents the blending weight.

* * * * *